US007198108B2

(12) United States Patent
Joynson et al.

(10) Patent No.: US 7,198,108 B2
(45) Date of Patent: Apr. 3, 2007

(54) CHANGING THE TEMPERATURE OF OFFSHORE PRODUCED WATER

(75) Inventors: Jeremy Duncan Stuart Joynson, Monaco (MC); Fabrice Dupray, Tourrette Levens (FR); Jack Pollack, Houston, TX (US)

(73) Assignee: Single Buoy Moorings, Inc., Houston, TX (US)

( * ) Notice: Subject to any disclaimer, the term of this patent is extended or adjusted under 35 U.S.C. 154(b) by 461 days.

(21) Appl. No.: 10/877,913

(22) Filed: Jun. 25, 2004

(65) Prior Publication Data

US 2005/0039913 A1 Feb. 24, 2005

Related U.S. Application Data

(60) Provisional application No. 60/517,295, filed on Nov. 3, 2003, provisional application No. 60/493,056, filed on Aug. 5, 2003.

(51) Int. Cl.
*E21B 29/12* (2006.01)

(52) U.S. Cl. ..... 166/357; 166/267; 210/673

(58) Field of Classification Search ..... 166/357, 166/267, 352, 366; 210/671, 673, 680, 693
See application file for complete search history.

(56) References Cited

U.S. PATENT DOCUMENTS

| | | | | |
|---|---|---|---|---|
| 4,235,607 | A * | 11/1980 | Kinder et al. | 95/223 |
| 5,188,805 | A * | 2/1993 | Sabottke | 422/111 |
| 5,236,589 | A * | 8/1993 | Torrance | 210/608 |
| 6,003,603 | A * | 12/1999 | Breivik et al. | 166/357 |
| 6,245,955 | B1 * | 6/2001 | Smith | 585/15 |
| 6,337,023 | B1 | 1/2002 | Broussard, Sr. et al. | |
| 6,502,635 | B1 * | 1/2003 | Underdown et al. | 166/267 |
| 6,578,366 | B1 | 6/2003 | Christiansen et al. | |
| 6,672,391 | B2 * | 1/2004 | Anderson et al. | 166/357 |
| 6,814,146 | B2 * | 11/2004 | Bass et al. | 166/302 |
| 6,845,727 | B2 * | 1/2005 | Eide et al. | 114/230.12 |
| 7,033,504 | B1 * | 4/2006 | Blytas et al. | 210/639 |
| 7,108,069 | B2 * | 9/2006 | Killie et al. | 166/336 |
| 2006/0260468 | A1 * | 11/2006 | Amin | 95/153 |

FOREIGN PATENT DOCUMENTS

| | | |
|---|---|---|
| WO | WO 00/39031 | 7/2000 |

* cited by examiner

*Primary Examiner*—Thomas A Beach
(74) *Attorney, Agent, or Firm*—Leon D. Rosen

(57) ABSTRACT

Water that is produced during offshore hydrocarbon processing, such as hot produced water accompanying hydrocarbons taken from subsea reservoirs, or cold water resulting from heating LNG (liquified natural gas) to convert it to gas, is changed in temperature to be closer to that of the surrounding sea using apparatus of minimal cost. The apparatus includes a mixer tube (52) that lies totally submerged in the sea and a nozzle (54) that receives the produced water and that has a nozzle end (76) lying in a middle portion of the mixer tube. A location of the mixer tube middle portion at the nozzle end has an inside diameter (A) much larger than the nozzle end outside diameter (B) to induce the through flow of sea water from the surrounding sea through the mixer tube. The produced water is pumped to a high enough pressure to create turbulence in the mixer tube immediately downstream of the nozzle end to better mix the produced and sea waters.

15 Claims, 3 Drawing Sheets

CHANGING THE TEMPERATURE OF OFFSHORE PRODUCED WATER

CROSS-REFERENCE

Applicant claims priority from U.S. provisional application No. 60/517,295 filed Nov. 03, 2003 and U.S. provisional application No. 60/493,056 filed Aug. 05, 2003.

BACKGROUND OF THE INVENTION

Large quantities of water are produced during the processing of hydrocarbons in offshore facilities. One example is in the production (removal) of hydrocarbons from subsea reservoirs by flowing the hydrocarbons up to a structure at the sea surface such as a floating vessel, a spar or floating tension leg platform (TPL), or a platform. Processing equipment on the sea surface structure separates the hydrocarbons from other material, which commonly consists primarily of water, and may include sand, etc. The large quantities of such produced water must be disposed of, either by injection into the reservoir (which is undesirable and costly) or by discharge into the environment. The produced water may be at an elevated temperature that is viewed by many as potentially detrimental to normal marine flora and fauna. Local regulations commonly require that large quantities of water such as the quantities commonly produced from undersea reservoirs, be cooled to a certain temperature before release into the sea.

In one example, water accompanying hydrocarbons from an undersea reservoir is at a temperature such as 90° C. (194° F.) and local regulations require that the temperature of discharged water be no greater than 40° C. (104° F.). Since the temperature of the sea is below that of hot water from the reservoir and the facility has ready access to sea water, it is logical to use sea water to cool the water from the reservoir. However, because of the large quantities of water that are produced (e.g. 1000 gallons per minute), the cost of conventional temperature-reduction heat equipment comprising sea water lift pumps, filters, heat-exchangers, etc. can be considerable. A cooling system with a minimal number of parts, which effectively cooled large quantities of produced water, would be of value.

There is a need for systems in the regassification of transported LNG (liquified natural gas), to heat cold water prior to its discharge into the sea. Gaseous hydrocarbons are commonly transported as LNG at −160° C. (−320° F.) if it contains methane, as LPG (propane and butane) at −50° C., or as hydrates (gas trapped in ice crystals) at −40° C., all at atmospheric pressure. Such gaseous hydrocarbons are offloaded, as directly into a gas pipeline whose outer end is located on a fixed or floating structure, so the gas can flow to shore and/or to an underground (under sea or shore) storage cavern for later use. The liquified gas is heated, as to 5° C. to avoid very cold pipes on which moisture condenses and to avoid cracking of walls of a salt dome cavern in which gas is stored. In this application it also is logical to use sea water to warm the very cold liquid to regas it. Local regulations may require that the temperature of large quantities of discharged water be at least 10° C. (50° F.).

In both the heating and cooling of produced water, local regulations require avoidance of "hot spots" or "cold spots" where marine life may be subjected to extreme temperatures. For examples, sea animals may be attracted to warm discharged water, and they must be protected from being burned as a result of a close approach to the location(s) where warm water is discharged into the sea. A system that changed the temperature of large quantities of discharged water to be closer to the temperature of the ambient or surrounding sea while avoiding "hot" or "cold" spots, and which used a low cost and effective system to accomplish this, would be of value.

SUMMARY OF THE INVENTION

In accordance with one embodiment of the present invention, a compact, low cost and efficient apparatus and method are provided for use in an offshore hydrocarbon processing facility that is located in a surrounding sea, that brings the temperature of produced water closer to the temperature of the surrounding sea while avoiding "hot" or "cold" spots. The apparatus includes a mixer tube that has input and output ends and a middle portion, and that is immersed in the sea. Produced water that is much hotter or colder than the sea, is flowed through a conduit down to a nozzle that has a nozzle end lying in the middle portion of the mixer tube and pointed toward the output, or downstream end, of the mixer tube. The downstream flow of produced water out of the nozzle induces the flow of sea water into the input end, or upstream end, of the mixer tube. The sea water that is induced to flow through the mixer tube, mixes with the produced water, and water that exits through the downstream end of the mixer tube is at a temperature much closer to that of the sea than the original produced water.

The nozzle end has a diameter that is no more than one half the diameter A of the middle portion of the mixer tube at the location of the nozzle end. This leaves a large area around the nozzle through which sea water can flow, to mix with the produced water. The mixer tube has a length of more than twice the mixer tube inside diameter A at the nozzle end, to provide time for the produced and sea water to mix. Input and output portions of the mixer tube are tapered in diameter, with the mixer tube ends having at least twice as great a diameter as the diameter A at the nozzle end, to induce the large flow of sea water through the mixer tube. The produced water is pressurized to flow sufficiently rapidly through the nozzle end to create turbulent flow through the mixer tube downstream portion, to better mix the produced and sea water.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
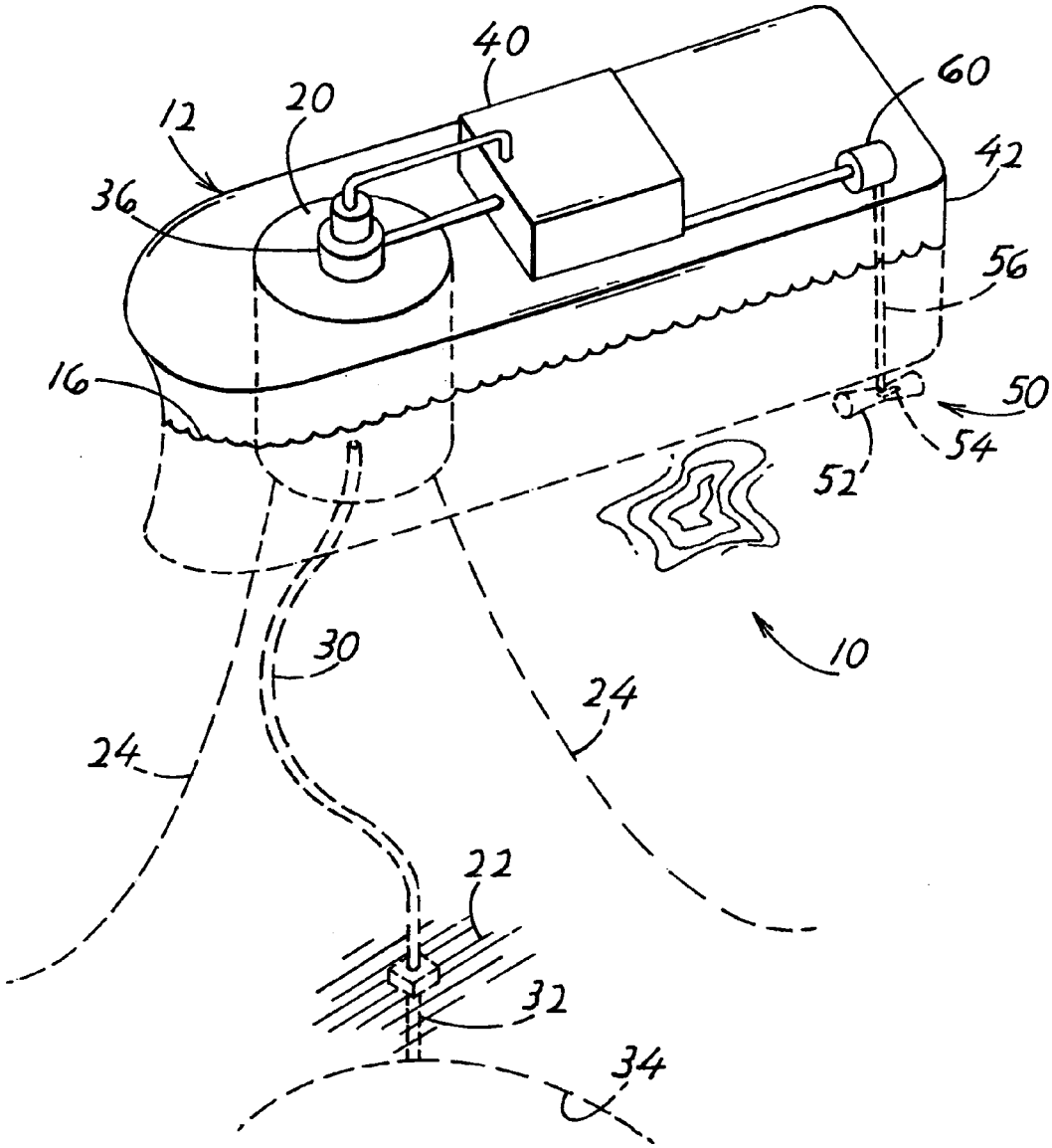
FIG. 1 is an isometric view of a facility of one embodiment of the present invention that produces hydrocarbons and large amounts of hot water from an undersea reservoir, and that efficiently cools the hot water before releasing it into the surrounding sea.

FIG. 1 illustrates a hydrocarbon production system 10 which includes a structure 12 in the form of a vessel that floats at the sea surface 16 and that supports a turret 20 that is anchored to the sea floor 22 by catenary chains 24. Risers 30 (only one is shown) extend from a pipe 32 that connects to a subsea reservoir 34, and carry fluid from the reservoir to a fluid swivel 36 at the top of the turret. The riser carries large quantities of water in addition to large quantities of hydrocarbons, and both may be at an elevated temperature. The fluid swivel connects to processing equipment 40 on the vessel hull 42 that separates the hydrocarbons from the hot water, any sand, etc. The hydrocarbons may be temporarily stored in the vessel hull and later offloaded to a tanker at intervals. Large quantities of hot produced water must be released from the processing equipment 40 and disposed of. Local regulations commonly require that any water discharged into the sea must not be so hot as to endanger flora and fauna in the sea.

In one example, hot water from the undersea reservoir is at a temperature such as 90° C. (194° F.) and local regulations require that the temperature of discharged water be no greater than 40° C. (104° F.). The regulations require that there be no "hot spots" of over 40° C. that might burn sea animals that closely approach the warm water. The surrounding sea may have a temperature such as 15° C. (59° F.) and it is logical to use the surrounding sea water to cool the hot water to the required release temperature or below it. Because of the large amount of hot produced water that must be released, it is important to use equipment of low cost and easy maintenance to cool the hot water.

Figure 2:
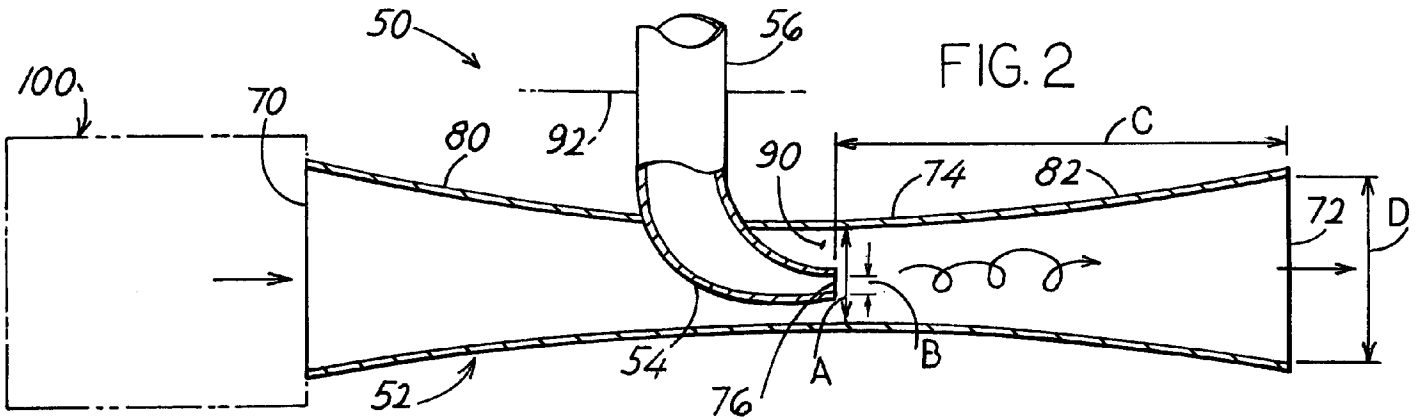
FIG. 2 is a sectional view of mixer apparatus of the facility of FIG. 1 for cooling the produced water.

In accordance with the invention, applicant cools the hot produces water by the use of apparatus 50 that comprises a mixer tube 52 that is submerged in the sea and a nozzle 54 that lies at least partially in the mixer tube. A conduit 56 carries the hot produced water from the processing equipment 40, though a pump 60 to the nozzle 54. The top of conduit 56 is a plurality of meters above the sea surface, so produced water pressure increases as the produced water moves down toward the nozzle. As shown in FIG. 2, the mixer tube 52 has an upstream or input end 70, a downstream or output end 72, and a middle portion 74. Both ends are open to the sea, except for a screen at each end. The nozzle 54 has a nozzle output end 76 that lies within the middle portion of the mixer tube. The nozzle end is directed towards the downstream end of the mixer tube. The nozzle has a reduced diameter at its end 76 which creates a high velocity stream of produced water. The mixer pipe has tapered end portions 80, 82 that are of progressively increasing diameters near the ends, leaving a constriction at the middle portion 74.

When the hot produced water is passed at a high pressure through the nozzle, high velocity produced water emerges at the nozzle end 76. The high velocity stream of produced water from the nozzle induces a large flow of sea water past the nozzle, resulting in a large flow of sea water into the mixer tube input end and out of the mixer tube output end. The sea water mixes with the hot produced water, resulting in the water emerging from the mixer tube output end having a temperature only moderately above the temperature of the surrounding sea.

It is important to avoid "hot spots", where water emerging from the mixer tube output end 72 might have a temperature much hotter than the average temperature of the water emerging from the mixer tube. Such "hot spots" are a result of incomplete mixing of the hot produced water with the cooler sea water. Applicant creates thorough mixing of the produced water and sea water by creating a turbulent flow of water along the downstream end portion 82 of the mixer tube. Such turbulent flow can be induced by several factors, including a sharp-edged obstacle downstream of the nozzle end, a rough mixer tube inside surface, etc. A major factor in creating turbulence is the difference in velocities between produced water exiting the nozzle end and sea water induced to flow downstream through the mixer tube. Applicant pumps the produced water to a high pressure before it passes through the nozzle to create a large velocity difference between produced and sea water to create such turbulence and consequent mixing. This usually requires that the velocity of produced water from the nozzle be at least 3 meters per second (10 feet per second).

The inside diameter A of the mixer tube at the nozzle end should be at least twice as large as the diameter B of the outside of the nozzle, so the area of the space 90 between them $[\pi(A^2-B^2)]$ is not so small that it creates a major constriction that greatly limits the flow rate of sea water. That is, the area of the space 90 between them should be a plurality of times the area of the nozzle end. However, the space 90 should not be too large (e.g., A should not be more than about 10 times B) or else produced water emitted from the nozzle will not induce a large sea water flow through the mixer tube. The input and output end portions of the mixer tube are tapered so the middle of the mixer tube is of a small diameter while the tube end portions are large enough to enable sea water flow with minimum resistance. The length C of the mixer tube downstream from the nozzle end should be at least twice and preferably at least three times the diameter A at the nozzle end to provide time and distance for the flowing produced and sea waters to mix. The input end portion 80 is similarly long and tapered to facilitate the flow of sea water to the tube middle portion. The mixer tube output end diameter D is at least twice the diameter A. Applicant prefers that the mixer tube lie under the bottom 92 of the vessel hull, and preferably at the rear of the vessel, so the warmed water emerging from the mixer tube does not tend to warm the vessel.

Figure 6:
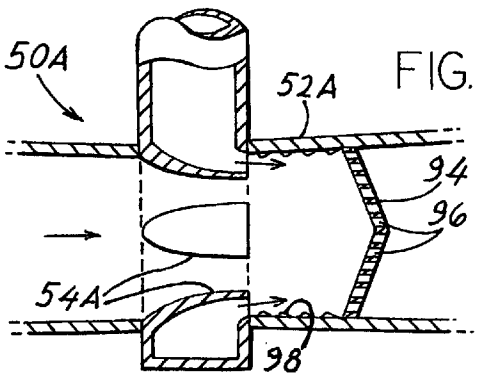
FIG. 6 is a sectional view of a portion of a mixer apparatus of another embodiment of the invention.

A variety of mixer tube-nozzle apparatuses can be designed, such as ones with more than one nozzle in a mixer tube. FIG. 6 illustrates a modified apparatus 50A which includes a plurality of nozzles 54A that lie around the periphery of the inside of the mixer tube 52A. An obstruction 94 with holes 96 lies downstream of the nozzles and there is a rough inside surface area 98 to help mix the produced and sea waters.

In one system that applicant has designed, of the type shown in FIG. 2, the mixer tube 52 has a length of one meter and has opposite ends 70, 72 that are each of 10 inches (25 cm) diameter. The middle has an inside diameter A of 4.5 inches (11.5 cm). The nozzle end 76 has an outside diameter of 1.2 inch (3 cm). FIG. 2 shows, in phantom lines, a submerged pump at 100 that can be connected to the input end 70 of the mixer tube to increase the inflow of sea water. In many facilities a larger mixer apparatus 50 is used to enable the discharge of larger flow rates of produced water.

Figure 4:
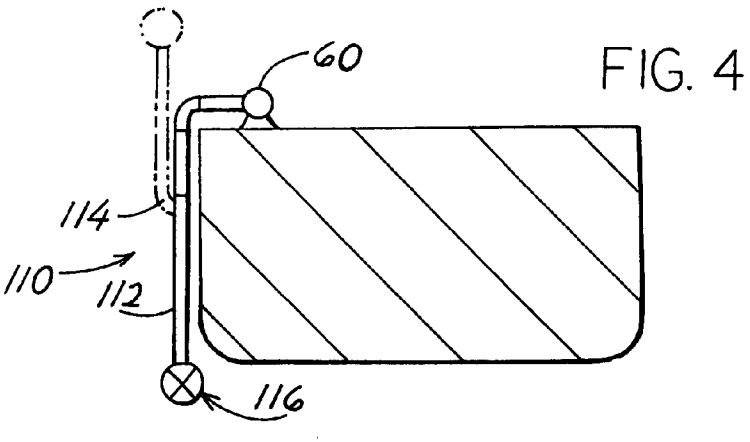
FIG. 4 is a sectional view of a structure similar to that of FIG. 3, but modified to enable the mixer tube to be lifted.
Figure 3:
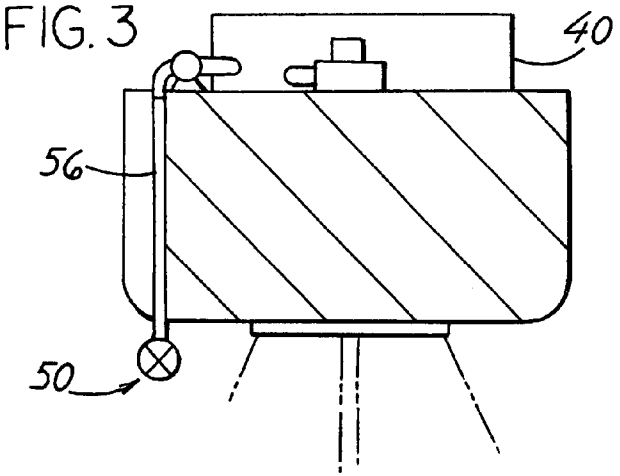
FIG. 3 is a sectional view of the sea surface structure of the facility of FIG. 1.

The vessel of FIG. 1 may move in shallow water prior to attachment of the mooring chains and sometimes afterwards. FIG. 4 shows a system 110 in which the conduit 112 that extends from the pump 60 to the mixer tube, extends outside a side of the vessel hull, and has a pivot joint 114. The pivot joint allows the mixer assembly 116 and much of the length of the conduit to be lifted in shallow water.

Figure 5:
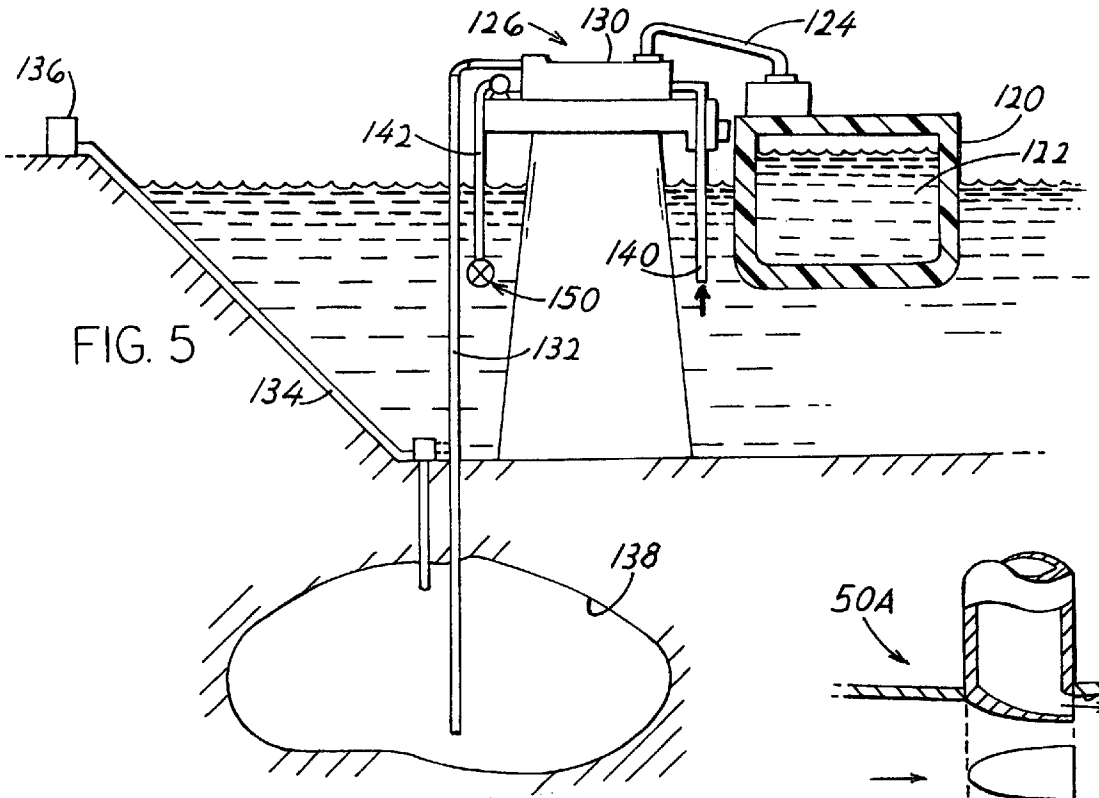
FIG. 5 is a sectional view of a facility that uses sea water to heat LNG (liquified natural gas) offloaded from a tanker, and that warms the sea water produced by the warming of LNG before discharging the produced water into the sea.

FIG. 5 illustrates a tanker 120 that carries LNG (liquified natural gas) 122 at a temperature such as −160° C. The LNG is offloaded through a cryogenic pipe or hose 124 to an offshore processing station 126, with a fixed platform being shown although a dedicated moored vessel could be used. The processing station includes a regas unit 130 that heats the LNG. The LNG is heated to turn it into a gas, and to a high enough temperature that when it is pumped through pipes 132, 134, to a shore station 136 and/or to a storage cavern 138, a lot of moisture will not condense on the pipes and the cavern will not crack.

The regas unit 130 uses sea water to heat the LNG, usually with an intermediate fluid for initial heating at low temperatures. The regas unit has a sea water inlet pipe 140 that takes in seawater and an outlet conduit 142 that disposes of the cooled seawater. In one example, the ambient sea is at 15° C. (59° F.) and the water flowing through the outlet conduit 142 is at 1° C. Also, local regulations require that discharged water be at at least 10° C. (50° F.). Thus, the produced water has to be heated only several degrees centigrade.

The outlet conduit 142 leads to a mixer assembly 150 of the same construction as shown in FIG. 2, although the dimensions can be varied because the temperature of the cold (1° C.) water in the outlet conduit does not have to be changed as much (e.g., by only 9° C. instead of 40° C.).

It should be noted that there are other applications where large amounts of water must be changed in temperature before being discharged into the sea. One of them is in the cooling of natural gas to produce LNG for transport in a tanker.

Thus, the invention provides an apparatus and method for use in an offshore hydrocarbon processing facility that produces large quantities of produced water, and which uses sea water to alter the temperature of the produced water before it is discharged into the open sea, in a low cost, compact and efficient manner. The apparatus includes a mixer tube that is immersed in the sea and that has upstream and downstream ends open to the sea and a middle portion. The apparatus also includes a nozzle that discharges the produced water within the middle portion of the mixer tube. The nozzle discharges the produced water at at least a moderate velocity to induce the flow of larger quantities of seawater through the mixer tube to mix with the produced water before exiting the downstream end of the mixer tube. The produced water is pressurized prior to exiting the nozzle to create rapid flow such as above 10 feet per second (3 meters per second) to create turbulent flow downstream of the nozzle so as to better mix the produced water with the sea water.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Apparatus for use in an offshore hydrocarbon processing facility that is located in a surrounding sea, to change the temperature of large quantities of produced water that flows out of a produced water conduit and that has a temperature that is a plurality of degrees Centigrade different from the temperature of the surrounding sea and for discharging the produced water into the surrounding sea without creating spots in the surrounding sea where the water is of a greatly different temperature than that of the rest of the sea, comprising:

a mixer tube that has input and output ends and that has a tube middle portion lying between said ends;

at least one nozzle that has a nozzle outlet end lying in said tube middle portion and that is directed toward said mixer tube output end;

said produced water conduit being connected to said nozzle to deliver said produced water to said nozzle to flow out from said nozzle end, said mixer tube input and output ends both lying in the surrounding sea, and at said nozzle outlet end the cross-sectional area of the inside of said mixer tube is a plurality of times the outside diameter of said at least one nozzle end, so produced water flowing out of said nozzle end induces the flow of large quantities of sea water through said mixer tube.

2. The apparatus described in claim 1 wherein:

said mixer tube has an inside diameter (A) at said nozzle output end, and said mixer tube extends downstream from said nozzle end by a distance (C) of more than twice the inside diameter (A) of said mixer tube at said nozzle end, to better mix produced and sea water.

3. The apparatus described in claim 1 wherein:

said mixer tube has an inside diameter (A) at said nozzle output end, and said mixer tube has a tapered output end portion that has a length (C) that is at least three times said middle tube diameter (A), and said middle tube diameter (A) is no more than one-half the diameter (D) of said mixer tube output end, whereby to create a long region of minimum water flow resistance along which there is mixing of sea water and produced water.

4. The apparatus described in claim 1 including:

a pump that pumps water along said conduit at a sufficient velocity that turbulent flow is established in at least a portion of the water between the output end of said at least one nozzle and the output end of said mixer pipe, to thereby thoroughly mix the processed water and the sea water entering the mixer pipe inlet end to avoid hot spots.

5. The apparatus described in claim 1 wherein:

said produced water conduit receives produced water from said processing facility at a location that is a plurality of meters above the sea surface, so water pressure increases along said conduit.

6. The apparatus described in claim 1 wherein:

said nozzle outlet end has a predetermined diameter (B), and said mixer tube has an inside diameter (A) at said nozzle outlet end that is between two times and ten times said outside diameter (B) of said nozzle end.

7. The apparatus described in claim 1 wherein:

said hydrocarbon processing facility includes a regas unit that heats liquified natural gas (LNG) and produces cold water, said produced cold water having a temperature that is less than 20° C. below the temperature of the surrounding sea, so the temperature of the produced water has to be raised by only several degrees.

8. The apparatus described in claim 1 wherein:

said hydrocarbon facility includes a cooler that cools hot water that comes from subsea wells along with hydrocarbons , said produced hot water having a temperature that is at least 30° C. greater than the temperature of the surrounding sea, so the temperature of the produced water has to be cooled by a plurality of tens of degrees C.

9. The apparatus described in claim 1 wherein said facility comprises a hull that floats in said surrounding sea and that has a hull bottom, and wherein:

said mixer tube lies below said hull bottom, whereby to better isolate the hull from the mixer output.

10. The apparatus described in claim 1 wherein said facility comprises a hull that floats in said surrounding sea and that has first and second opposite hull sides, and wherein:

said conduit lies beyond said first side of said hull, and said conduit includes upper and lower conduit parts and a joint that connects said conduit parts to allow the lower conduit part to be raised.

11. The apparatus described in claim 1 including:

a pump that pumps sea water into the input end of the mixer tube.

12. Apparatus for use in an offshore hydrocarbon processing facility that is located in a surrounding sea, to change the temperature of large quantities of produced water that flows out of a produced water conduit and that has a temperature that is a plurality of degrees Centigrade different from the temperature of the surrounding sea, comprising:

a mixer tube that has input and output ends and that has a tube middle portion lying between said ends;

at least one nozzle that has a nozzle outlet end lying in said tube middle portion and that is directed toward said mixer tube output end;

said produced water conduit being connected to said nozzle to deliver said produced water to said nozzle to flow out from said nozzle end, said mixer tube input and output ends both lying in the surrounding sea, and at said nozzle outlet end the cross-sectional area of the inside of said mixer tube is a plurality of times the outside diameter of said at least one nozzle end, so produced water flowing out of said nozzle end induces the flow of large quantities of sea water through said mixer tube.

13. A method for use in an offshore facility that is located in a surrounding sea and that is engaged in the processing of large quantities of hydrocarbons, wherein the processing of large quantities of hydrocarbons produces large quantities of produced water wherein the produced water has a temperature that is many degrees centigrade different from the temperature of the surrounding sea, comprising:

passing the produced water down to a nozzle that lies within a middle portion of a mixer tube wherein the mixer tube is immersed in the sea, and directing the produced water out of a nozzle end that is directed toward an open downstream end of the mixer tube, while allowing sea water to flow into an open upstream end of the mixer tube, to thereby mix the produced water with sea water so water exiting the mixer tube has a temperature closer to that of the surrounding sea than the temperature of the produced water.

14. The method in claim 13 wherein:

said step of directing produced water out of a nozzle end includes emitting the produced water out of the nozzle end at a velocity that is sufficient to produce turbulent water flow at least immediately downstream of the nozzle, whereby to better mix the produced water with the sea water.

15. The method described in claim 13 including:

pumping sea water into said upstream end of said mixer tube.

* * * * *